United States Patent [19]

Mochizuki et al.

[11] Patent Number: 4,528,823

[45] Date of Patent: Jul. 16, 1985

[54] HEAT PUMP APPARATUS

[75] Inventors: Taketoshi Mochizuki, Shimizu; Mituo Kudo, Tsuchiura; Takao Senshu, Shizuoka; Hideyuki Kimura, Ibaraki, all of Japan

[73] Assignee: Hitachi, Ltd., Tokyo, Japan

[21] Appl. No.: 482,608

[22] Filed: Apr. 6, 1983

[30] Foreign Application Priority Data

Apr. 14, 1982 [JP] Japan ..... 57-61051

[51] Int. Cl.[3] ..... F25B 13/00

[52] U.S. Cl. ..... 62/324.6; 62/335; 62/510

[58] Field of Search ..... 62/510, 502, 114, 332, 62/335, 324.6, 324.7

[56] References Cited

U.S. PATENT DOCUMENTS

Re. 21,600 10/1940 Schwarz ..... 62/335 X 2,342,566 2/1944 Wolfert ..... 62/324.6

2,897,659 8/1959 Wergner ..... 62/510 X 3,092,976 6/1963 Hashemi-Tafreshi ..... 62/510 X

FOREIGN PATENT DOCUMENTS 338283 6/1921 Fed. Rep. of Germany ..... 62/510

*Primary Examiner*—Lloyd L. King

*Attorney, Agent, or Firm*—Antonelli, Terry & Wands

[57] ABSTRACT

A heat pump apparatus has a main refrigerant circuit constituted by a closed loop including a compressor, condenser, gas-liquid separator, pressure reducer such as an expansion valve, and an evaporator. A shunting refrigerant line having a compressor, condenser and a pressure reducer means shunts from the gaseous phase portion of the gas-liquid separator of the main refrigerant circuit and merges in the evaporator of the main refrigerant circuit. The shunting refrigerant line may be constructed to have one or more compression stages.

4 Claims, 9 Drawing Figures

HEAT PUMP APPARATUS

BACKGROUND OF THE INVENTION

The present invention relates to a heat pump apparatus incorporating a compression type refrigerating circuit and, more particularly, to a heat pump apparatus having a plurality of compressors and heating condensers connected to the compressors.

Various problems are encountered in the generation of hot water or hot air by a heat pump apparatus incorporating a compression type refrigeration circuit. For example instance, the coefficient of performance of the compressor is reduced due to a large pressure difference between the high-pressure side and low-pressure side of the refrigeration circuit. Moreover, the temperature of the refrigerant gas discharged from the compresor is often raised abnormally to a level above the decomposition temperature of the refrigerant.

In, for example, Laid-Open Patent Applications Nos. 114033/75, 118342/75 and 29934/72, an apparatus for generating high temperature is proposed wherein a compression type refrigeration circuit is used as a heat pump. Additionally, in, for example, Japanese Laid-Open Patent Applications 114033/75 and 118342/75, a warm water generating apparatus is associated with air conditioner, in which a condenser for generating warm water is provided at the discharge side of the compressor separately from the condenser for air conditioner so that warm water is generated by the superheated temperature component of the refrigerant gas discharged from the compressor. Usually, the air conditioner is operated at a comparatively low temperature range, e.g. 50° C. in terms of condensation temperature, in order to avoid various troubles such as damaging of compressor by heat and thermal decomposition of the refrigerant and the lubricant. In this warm water generating system, however, the heat of the superheated temperature component is comparatively small and the temperature level of this heat is rather low. Therefore, additional heating by an auxiliary electric heater or boiler is essential for obtaining a large amount of warm water or warm water of a high temperature level.

In aforementioned Japanese Laid-Open Application No. 29934/72 a system for generating hot water utilizes two heat pump type refrigeration circuits. Namely, warm water generated in the condenser of the heat pump type refrigeration circuit operating at lower temperature is utilized as the heat source of the heat pump type refrigeration circuit operating at higher temperature, so that a condensation temperature, considerably higher than that of the first refrigeration circuit, is attained in the second refrigeration circuit to permit the generation of warm water of high temperature. The refrigeration circuit operating at higher temperature makes use of a refrigerant the vapor pressure of which is not so high even at a high temperature. It is, therefore, possible to obtain warm water of high temperature well reaching 80° C. This system, however, suffers from a problem that the coefficient of performance is considerably low as compared with other systems incorporating only one refrigeration circuit.

Systems pertinent to the invention of this application, incorporating multi-stage compressor or a plurality of compressors and receivers, are disclosed in Japanese Utility Model Laid-Open Applications Nos. 78849/74 and 60754/79; however, these systems do not make use of the heat medium of high temperature but a heat medium of low temperature cooled by evaporator.

More specifically, in the system disclosed in Laid-Open Application 78849/74, a compound compressor having two stages is provided, with the refrigerant gas, discharged from the compressor of low pressure stage being introduced into a receiver where it merges in the liquid refrigerant condensed in the condenser of the high pressure stage to form an almost saturated refrigerant gas which is drawn in by the compressor of the high pressure stage. The heat taken from the heat medium of lower temperature in the evaporator of the low pressure stage is delivered to the outside through the condenser of the high pressure stage. There is no heat exchanging relationship between the outside and the intermediate pressure section connected to the discharge side of the compressor of low pressure stage. Namely, in the intermediate pressure section, the heat is exchanged only between the refrigerant fractions in the refrigeration system, i.e. only between the refrigerent gas of high temperature discharged from the compressor of high low pressure stage and the liquid refrigerant in the high pressure stage. When this system is used for generating a heat medium of high temperature, the coefficient of performance is inevitably low as compared with a single-stage refrigeration system, because the system operating in two stages cannot produce heat greater than that produced by the single-stage refrigeration system, due to inability to use the heat possessed by the refrigerant gas discharged from the compressor of the low pressure stage. However, in this system, problems, such as, for example, damaging of compressor by excessive heat and thermal decomposition of lubricant and refrigerant, are avoided due to a comparatively low temperature of the gas discharged from the compressor of high pressure stage because the latter draws almost saturated refrigerant gas.

The system in Japanese Utility Model Laid-Open Application No. 60754/79 differs from that shown in Laid-Open Application No. 78849 only in that this system incorporates two compressors and the gas, discharged from the compressor of the low pressure side, does not merge in the liquid refrigerant in the high presure side but makes a heat exchange with the latter.

Accordingly, it is an object of the invention to provide a heat pump apparatus incorporating a compression type refrigeration circuit having a high operation efficiency, capable of delivering air or water of high temperature.

Another object of the invention is to provide a heat pump apparatus which can permit a selection of the temperature range of warm water or air and, hence, deliver warm air or water of desired temperature level.

Still another object of the invention is to provide a heat pump apparatus which can generate not only warm air or water but also a heat medium of low temperature such as cold air or water.

A further object of the invention is to provide a heat pump apparatus which can effectively be applied to an air conditioner.

To these ends, according to the invention, a heat pump apparatus is provided which comprises a main refrigerant circuit having a compressor, condenser, gas-liquid separator, a presure reducing means (expansion valve) and an evaporator which are connected to form a closed loop, and an auxiliary refrigerant line shunting from the gaseous phase portion of the gas-liquid separator and leading to the evaporator through a compressor, condenser, and a pressure reducing means which are provided separately from those of the main refrigerant circuit.

In operation, the gaseous refrigerant of high temperature and pressure, discharged from the compressor, is introduced into the condenser to heat a heat output medium such as water, air or the like circulated through the condenser. As a result of this heat exchange, the refrigerant itself is condensed into liquid and then flows into the gas-liquid separator where the gaseous phase of the refrigerant is separated from the liquid phase. The liquid refrigerant then flows through the presure reducing means (expansion valve) into the evaporator where the refrigerant is evaporated through a heat exchange with an external heat source. The evaporated through a heat exchange with an external heat source. The evaporated refrigerant is returned to the suction side of the compressor.

On the other hand, the gaseous refrigerant, which is in saturated state and accumulated in the upper part of the gas-liquid separator, is introduced to and compressed by the compressor of the shunting refrigerant line. The gaseous refrigerant of high temperature and pressure discharged from the compressor is introduced into the condenser of the shunting refrigerant line and is condensed at a temperature higher than the condensation temperature in the main refrigerant circuit, while additionally heating the heat output medium which has been heated in the condenser of the main refrigerant circuit. Alternatively, the condensation in the condenser of the shunting refrigerant line is accomplished by the heat derived from another heat output medium so that heat output mediums of different temperatures are served by the heat pump apparatus as a whole. It is also possible to use a non-azeotropic refrigerant mixture and, in such a case, most of the refrigerant component having higher boiling point is condensed in the condenser of the main refrigerant circuit, while the refrigerant component of lower boiling point is separated in gaseous phase within the gas-liquid separator. This gaseous refrigerant is introduced into the condenser of the shunting refrigerant lines and is condensed at a temperature higher than the condensation temperature of the main refrigerant circuit, while additionally heating the heat output medium to a higher temperature.

According to the invention, it is possible to increase the number of the shunting refrigerant lines in compliance with the demand for different temperature levels of the heat output medium, Namely, it is possible to obtain desired temperature levels corresponding in number to the number of the shunting refrigerant lines.

When a plurality of shunting refrigerant lines are incorporated, it is possible to obtain a higher temperature of the output heat medium by using a nonazeotropic refrigerant consisting of three components of high, low and medium boiling temperature and by arranging the same such that these components are condensed in the condenser of the main refrigerant circuit, condenser of the first shunting refrigerant line and the condenser of the second shunting refrigerant line, respectively.

Thus, in the heat pump apparatus of the invention, the compressor of the shunting refrigerant line draws almost saturated gaseous refrigerant separated by the gas-liquid separator and discharges the compressed gaseous refrigerant at a temperature which is sufficiently lower than the decomposition temperature of the refrigerant which materially limits the range of operation of the heat pump apparatus. Therefore, the condensation temperature in the shunting refrigerant line can be elevated to a level higher than that in the refrigeration circuit having a single compressor, i.e. refrigerant circuit having a single compression stage, which in turn permits the generation of higher temperature of the heat output medium such as water and air. In addition, the efficiency of the heat pump apparatus as as whole as remarkably improved because it is not necessary to compress the whole part of the refrigerant to high condensation pressure.

It is of course possible to obtain a heat medium of low temperature in the evaporator of the heat pump apparatus of the invention. In a preferred form in which each shunting refrigerant line has an evaporator, it is possible to independently cool heat media in the respective evaporators or, alternatively, to cool a heat medium first in the evaporator of high evaporation temperature through a heat exchange with a refrigerant components of higher boiling point and then in another evaporator of lower evaporation temperature through a heat exchange with the refrigerant component of lower boiling point. In the latter case, it is possible to obtain a heat medium of a lower temperature.

In another preferred form, the gas-liquid separator is provided with a heater whereby it is possible to control the capacity of the heat pump apparatus in three stages by suitably selecting one of three operation modes: namely, a first mode in which only the main refrigerant circuit operates, a second mode in which only the shunting refrigerant line operates and a third mode in which both of the main refrigerant circuit and the shunting refrigerant line operates.

According to still another preferred form, the heat pump apparatus is provided with a four-way valve for switching the flow of the refrigerant, an expansion valve for heating, an expansion valve for cooling and check valves disposed in respective expansion valves, so that the heat pump apparatus can operate selectively either in heating mode or cooling mode. With this arrangement, it is possible to attain a greater heating capacity and, hence, a higher temperature of heated air, while, in the cooling mode, only the main refrigeration circuit operates. Thus, the heat pump apparatus of this arrangement can be used as an air conditioner suited for use in cold district where the heating load or demand is much greater than the cooling load or demand.

These and other objects, features and advantages of the invention will become clear from the following description of the preferred embodiments taken in conjunction with the accompanying drawings.

DETAILED DESCRIPTION

Figure 1:
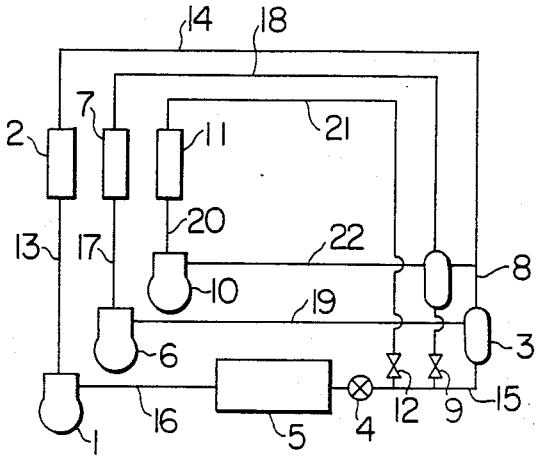
FIG. 1 is a refrigerant circuit diagram of an embodiment of the invention incorporating a refrigerant circuit having two shunting refrigerant lines.

Referring now to the drawings wherein like reference numerals are used throughout the various views to designate like parts, and more particularly, to FIG. 1, according to this figure, a a heat pump apparatus includes a compressor 1, first condenser 2, first gas-liquid separator 3, a pressure reducing means 4 such as expansion valve (referred to as expansion valve), and an evaporator 5 which are connected to form a closed loop constituting a main refrigerant circuit. A shunting pipe 19 is connected to the gas phase portion in the upper part of the first gas-liquid separator 3. The shunting pipe 19 leads to the suction side of a second compressor 6 which is connected at its discharge side to a second condenser 7 to which, connected in series, are a second gas-liquid separator 8, and a second presure reducing means 9 such as a pressure reducing valve. The second pressure reducing means 9 is connected to a liquid pipe 15 at the inlet side of the expansion valve 4 of the main refrigerant circuit to complete a second refrigerant line. A third refrigerant line is formed by a shunting pipe 22 connected to the gas phase portion of the second gas-liquid separator 8, third compressor 10, third condenser 11 and a third pressure reducing means 12 such as a pressure reducing valve connected to the liquid line 15 at the inlet side of the expansion valve 4 of the main refrigerant circuit. The main refrigerant circuit, second refrigerant line and the third refrigerant line in combination constitute a refrigeration system. A so-called non-azeotropic refrigerant mixture containing refrigerant comonents of different saturation temperatures, e.g. a mixture of FREON system refrigerants R114, R12 and R22, is circulated in this refrigeration system.

The heat pump apparatus operates in the following manner. The gaseous refrigerant of high temperature, discharged from the first compressor 1, is introduced into the first condenser 2 through the pipe 13. In the first condenser 2, the refrigerant, R114 for example, which is the refrigerant component of the highest boiling point is condensed while heating a heat output medium such as water or air. The refrigerant is then introduced into the first gas-liquid separator 3 where the gas phase and the liquid phase of the composite refrigerant are separated from each other. The liquid phase of the composite refrigerant is introduced through the liquid pipe 15 to the expansion valve 4 and then to the evaporator 5 where the liquid phase of the composite refrigerant absorbs heat from external heat source and is evaporated by the absorbed heat. The evaporated refrigerant is then returned to the suction side of the first compressor 1. On the other hand, the gaseous phase of the refrigerant containing refrigerant components of medium and low boiling points such as, for example, R12 and R22, is accumulated in the upper portion of the first gas-liquid separator 3. This gaseous phase of the refrigerant is introduced to the suction side of the second compressor 6 through the shunting pipe 19. The gaseous phase of the composite refrigerant, compressed by the second compressor 6 to a higher presure and temperature, is introduced to the second evaporator 7 in which the refrigerant component of medium boiling point rich in R12 is condensed at a condensation temperature higher than that in the first condenser 2, while additionally heating the heat output medium which has been heated already in the first condenser 2. The condensed refrigerant then flows into the second gas-liquid separator 8 where the gaseous phase and the liquid phase of the refrigerant are separated from each other. The liquid phase accumulated in the bottom portion of the separator 8 is introduced through the second pressure reducing means 9 into the liquid pipe 15 of the main refrigerant cirucit, while the gaseous phase of the refrigerant accumulated in the upper part of the second gas-liquid separator 8, consisting mainly of R22 having a low boiling point, is drawn in and compressed by the third compressor 10 to a higher pressure and temperature. The refrigerant discharged from the compressor 10 is introduced into the third condenser 11 where it is condensed while further heating the heat output medium which has been heated in the second condenser 7. The refrigerant perfectly condensed in the third condenser 11 is returned through the third pressure reducing means 12 into the liquid pipe 15 of the main refrigerant circuit 15 where it merges in the liquid refrigerant component of high boiling point from the first liquid separator 3 and the liquid refrigerant component of medium boiling point coming from the second gas-liquid separator 8. The mixture of the liquid refrigerant components is then returned through the expansion valve 4 and the evaporator 5 to the suction side of the first compressor 1 to complete the refrigeration cycle, with this operation being cyclically repeated.

In this operation of the heat pump apparatus, the second compressor 6 and the third compressor 10 draws refrigerant components in almost saturated states, so that the discharge temperatures at the discharge sides of these compressor 6 and 10 are maintained at comparatively low levels. It is, therefore, possible to avoid troubles such as thermal decomposition of the lubricant and refrigerant, damaging of the compressor and so forth. This means that the heat pump apparatus is allowed to operate at a higher pressure, i.e. at a higher condensation temperature. In addition, since the heat output medium is heated in three stages at three different condensation temperature, it is not necessary to compress the refrigerant components to the highest condensation temperatures. Therefore, the power consumptions by the compressors are reduced to permit the heat pump apparatus to operate at higher coefficient of performance.

It will be understood that the invention affords an efficient production of the heat output medium such as water and air of high temperature at a sufficiently large rate.

Although a non-azeotropic refrigerant mixture consisting of refrigerant components of different boiling points such as R114, R12 and R22 is used as the refrigerant, the use of the composite refrigerant is not exclusive and the heat pump apparatus of the invention can operate with a refrigerant having a single refrigerant component. In such a case, it is necessary to control the operation more precisely to attain the condensation rates at the first and second condensers 2 and 7 in conformity with the designed ratio of heat exchange. For example, the operation is controlled such that the first and second condensers 2 and 7 share an equal part (33%) of the total amount of heat exchange performed by the heat pump apparatus as a whole.

Figure 2:
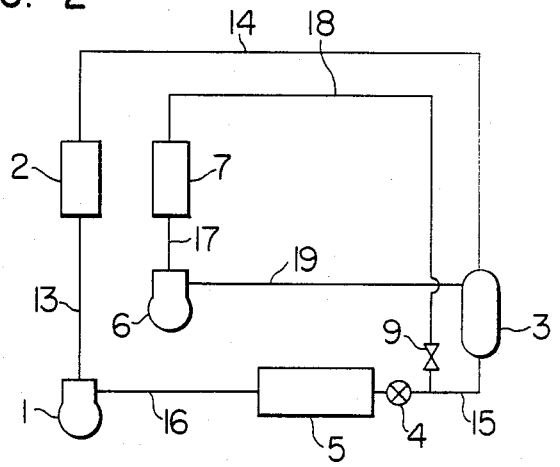
FIG. 2 is a refrigeration circuit diagram of another embodiment of the invention incorporating a refrigerant circuit having one shunting refrigerant line.

When there is no demand for heating the heat output medium to a specifically high temperature, the heat pump apparatus of this embodiment operates in the following manner. Namely, in such a case, the operation of the third compressor 10 is suspended to stop the operation of the third refrigeration line, so that the heat pump apparatus operates with a refrigeration system shown in FIG. 2 composed of the main refrigerant circuit and the second refrigerant line which is not provided with the gas-liquid separator. Consequently, the heat output medium is heated only in two stages by the first and the second condensers 2 and 7. The operation of the apparatus is materially same as that explained before in connection with FIG. 1, except that the gaseous phase of the refrigerant is completely condensed in the second condenser 7. If it is desired to further reduce the temperature of the heat output medium, the operation of the second compressor 6 is stopped so that the refrigerant is circulated only through the main referigerant circuit. In this case, the gaseous refrigerant discharged from the first compressor 1 is completely liquefied by the first condenser 2.

To the contrary, when it is desired to attain a higher temperature of the heat output medium than that attained in the embodiment shown in FIG. 1, it is possible to further heat the heat output medium by connecting a forth refrigerant line (not shown) as follows. Namely, the fourth refrigerant line (not shown), constituted by a fourth compressor, fourth receiver and a fourth pressure reducing means, is connected between a third gas-liquid separator disposed at the outlet side of the third condenser 11 of the third refrigerant line and the liquid pipe 15 of the main refrigerant circuit. The arrangement is such that the heat output medium heated by the first condenser and then by the second and third condensers is further heated by the fourth condenser. It is thus possible to expand the refrigeration circuit of the heat pump apparatus to a system having n refrigerant lines.

In the embodiment shown in FIG. 1, a high temperature of the heat output medium is attained by heating the heat output medium in a stepped manner. However, the embodiment of FIG. 1 may be modified such that the condensers are arranged to heat the heat output medium or mediums independently to permit the generation of heat output medium or mediums of different output temperature.

Figure 3:
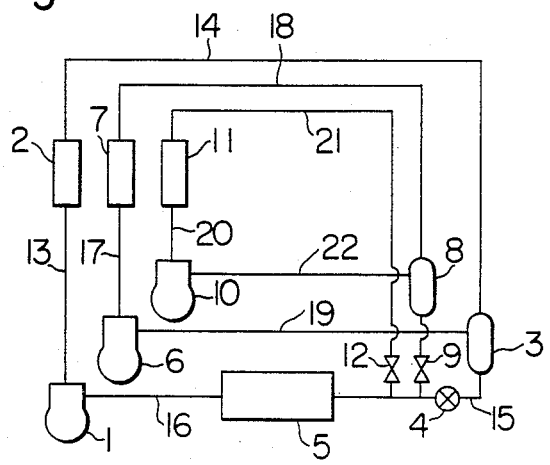
FIG. 3 is a refrigerant circuit diagram of still another embodiment of the invention incorporating a refrigerant circuit having two shunting refrigerant lines.

Furthermore, in the embodiment shown in FIG. 1 the liquid outlet pipes of the second pressure reducing means 9 and the third pressure reducing means 12 are connected commonly to the liquid pipe 15 of the main refrigerant circuit 15. These liquid outlet pipes, however, may be connected to the first gas-liquid separator 3 or, alternatively, to the pipe between the pressure reducing means 4 and the evaporator 5 as shown in FIG. 3. Other portions are materially identical to those of the embodiment shown in FIG. 1. The operation of the embodiment shown in FIG. 3 is not descried here because it is substantially the same as that of the embodiment shown in FIG. 1.

Figure 4:
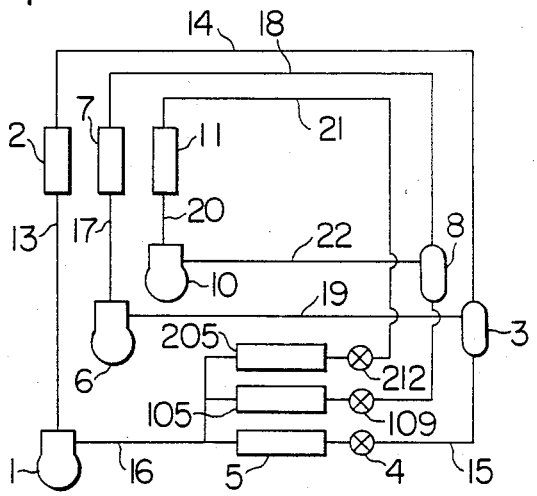
FIG. 4 is a refrigerant circuit diagram of a further embodiment of the invention having a refrigerant circuit having two shunting refrigerant lines each including an evaporator.

In FIG. 4, separate evaporators 105 and 205 are provided at the outlet sides of the second and third pressure reducing means 109 and 212, respectively, and the refrigerant from different lines merge in each other at the outlet sides of the evaporators 105 and 205. Other portions are materially identical to those of the embodiment shown in FIG. 1.

Figure 5:
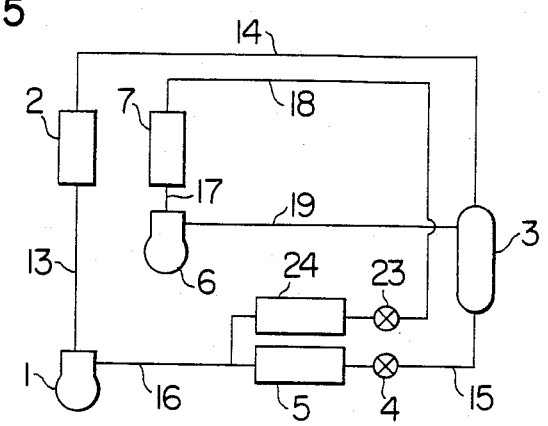
FIG. 5 is a refrigerant circuit diagram of a still further embodiment of the invention having a refrigerant circuit provided with a single shunting refrigerant line including an evaporator.

In FIG. 5, a more simple refrigeration system is provided which includes a main refrigerant circuit and a second refrigerant line, with an expansion valve 23 being used at the pressure reducing means of the second refrigerant line. The embodiment of FIG. 5 permits the utilization of low temperature generated in the evaporators. Namely, when it is desired to use of the low temperature, a heat output medium or mediums are independently heated in the separate evaporators 5 and 24, or alternatively, a heat output medium is cooled first in the evaporator 5 in which the refrigerant component of higher boiling temperature is evaporated and then cooled to lower temperature in the evaporator 24 in which the refrigerant component of lower boiling temperature is evaporated.

Figure 6:
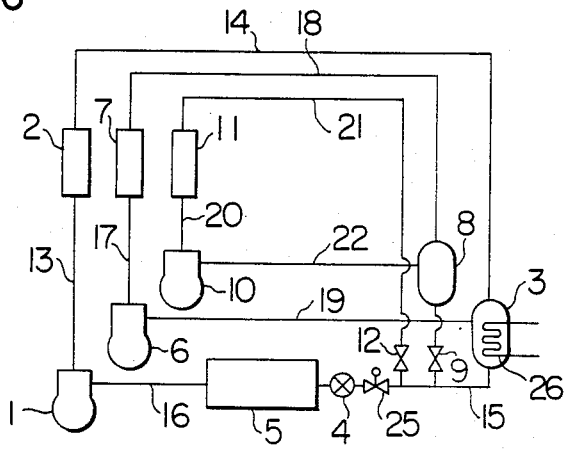
FIG. 6 is a refrigerant circuit diagram of another embodiment having a refrigerant circuit having two shunting refrigerant lines and a heater mounted in a gas-liquid separator.

The embodiment of FIG. 6 has a refrigeration system materially identical to that shown in FIG. 1 but includes a heater 26 provided in the first gas-liquid separator 3 and a solenoid valve 25 provided at the inlet side of the expansion valve 4 of the main refrigerant circuit.

The refrigeration system of FIG. 6 operates in the same manner as that shown in FIG. 1 provided that the solenoid valve 25 is opened while the heater 26 is held inoperative. The refrigeration system of FIG. 6, however, operates only with the main refrigerant circuit constituted by the first compressor 1, first condenser 2, first gas-liquid separator 3, expansion valve 4 and the evaporator 6, if the solenoid valve 25 is kept opened while the second and third compressors 6 and 10, as well as the heater 26, is maintained inoperative.

In another operation mode, the solenoid valve 25 is closed and the first compressor 1 is stopped while the second and third compressors, as well as the heater 26, are made to operate. In this operation mode, the refrigeration system works only with the second refrigerant line and the third refrigerant line. For information, the second refrigerant line is constituted by the second compressor 6, second condenser 7, second gas-liquid separator 8, second pressure reducing means 9, pipe 15, first gas-liquid separator 3 and the branch pipe 19, while the third refrigerant line is composed of the third compressor 10, third condenser 11 and the third pressure reducing means 12. In this operation mode, the first gas-liquid separator 3 works as an evaporator because heat is supplied externally to the heater 26. The gaseous phase of the refrigerant generated in the first gas-liquid separator is introduced to the second compressor 6. The subsequent flow of the refrigerant through the second and third refrigerant lines is identical to that explained before in connection with FIG. 1.

As has been described, in this embodiment of the invention, it is possible to effect a capacity control by selectively using either one of two operation modes. It is also possible to use a waste heat as the heat delivered to the heater. In the operation mode in which only the main refrigerant circuit operates, it is possible to increase the cooling power through super-cooling the liquid refrigerant by supplying cooling water to the heater. The heater may be an electric heater if it is intended only for the heating purpose.

Figure 7:
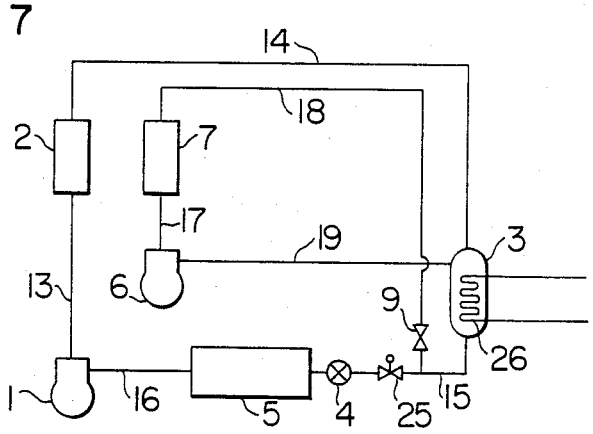
FIG. 7 is a refrigerant circuit diagram of yet another embodiment having a refrigerant circuit provided with a single shunting refrigerant line and a heater mounted in a gas-liquid separator.

The embodiment of FIG. 7 is suitable for us in such a case that the demanded heating power is not so large and the aimed temperature of the heat output medium is not so high. As shown in FIG. 7, the embodiment lacks the second gas-liquid separator 8 of the second refrigerant line and all constituents of the third refrigerant line. To the contrary, it is possible to expand the refrigerant system to have n refrigerant lines.

Figure 8:
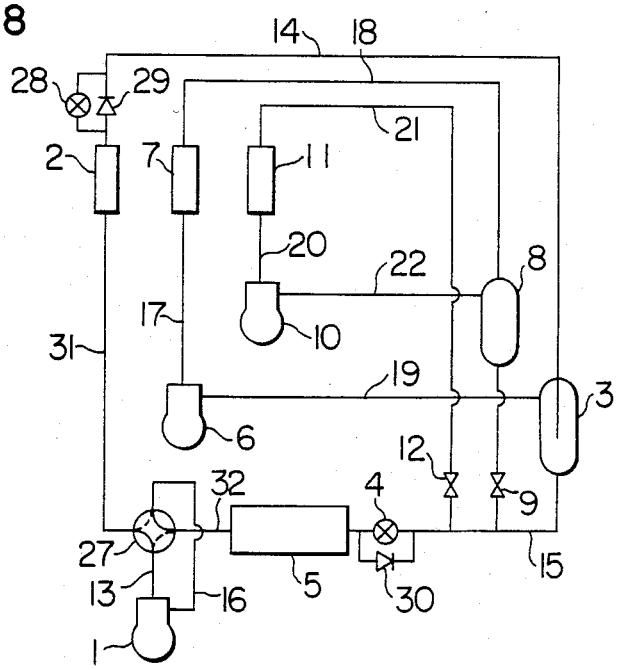
FIG. 8 is a refrigerant circuit diagram of a further embodiment having a refrigerant circuit provided with two shunting refrigerant lines and a four-way valve for switching the flow of the refrigerant.

In the embodiment of FIG. 8, in addition to the refrigeration circuit as shown in FIG. 1, a four-way valve is provided for switching the flow of refrigerant, a parallel connection of an expansion valve 4 and a check valve 30 at the inlet of the evaporator 5 and a combination of an expansion valve 28 and a check valve 29 between the first condenser 2 and the gas-liquid separator 3. This refrigeration system can operate either in heating mode for heating air or water or cooling mode for cooling air or water. The evaporator 5 serves as an evaporator in the heating mode but operates as a condenser in the cooling mode. To the contrary, the condenser 2 operates a condenser in the heating mode but operates as an evaporator in the cooling mode. In the operation of the heating mode, the four-way valve is positioned as illustrated by full lines to connect the discharge pipe 13 of the first compressor 1 to the pipe 31 leading to the first condenser 2.

For the operation in the cooling mode, the second compressor 6 and the third compressor 10 are stopped and the four-way valve is switched to the position illustrated by broken lines to provide a communication between the discharge pipe 13 of the first compressor 1 and the pipe 32 leading to the evaporator 5 whih works as a condenser in the cooling mode operation. Namely, the gaseous refrigerant of high temperature and presure, discharged from the first compressor 1, is introduced through the four-way valve 27 to the evaporator 5 which serves as a condenser in the cooling mode operation so as to condense the refrigerant into liquid phase. The refrigerant, now in the liquid phase, is introduced through the first gas-liquid separator 3 and the expansion valve 28 into the condenser 2 which serve, in the cooling mode operation, as an evaporator so that the refrigerant is evaporated while cooling a heat output medium. The evaporated refrigerant is then returned to the first compressor 1 through the four-way valve 27. This operation is repeated to effectively cool the heat output medium.

When the refrigeration system of this embodiment is applied to an air conditioner, all of the first, second and third compressors 1, 6 and 10 operate to increase the heating power. Namely, the air as the heat output medium is heated to a high temperature in three stages to ensure a pleasant feel of air heating. To the contrary, in the cooling mode operation, only the first compressor 1 is operated. Therefore, this refrigeration system is suited particularly to the use in cold districts where the heating load or demand is much greater than the cooling load or demand. In the heating mode operation, the moisture in the drawn in ambient air is inconveniently frosted on the evaporator 5. In such a case, a defrosting operation is made provided that the first gas-liquid separator 3 is provided with a heater as shown in FIG. 7, by allowing the main refrigerant circuit to operate in cooling mode, through the switching of the four-way valve. Namely, in such an operation, the heat derived from the heater 26 is effectively used for the defrosting.

Figure 9:
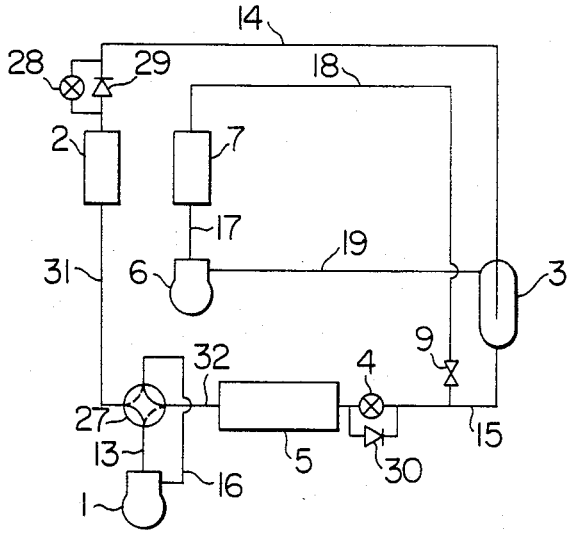
FIG. 9 is a refrigerant circuit diagram of still further embodiment of the invention incorporating a refrigerant circuit provided with a single shunting refrigerant line and a four-way valve.

In the case where the demand for heating power is not so large and the aimed temperature of the air is not so high, it is possible to use a refrigeration circuit without the second gas-liquid separator of the second refrigerant line and the constituents of the third refrigerant line, as shown in FIG. 9. To the contrary, the number of the refrigerant lines combined with the main refrigeration circuit can be increased in accordance with the demand for the heating power.

Although the invention has been described through specific terms, it is to be noted here that the described embodiments are no exclusive and various changes and modifications may be imparted thereto without departing from the scope of the invention which is limited solely by the appended claims.

What is claimed is:

1. A heat pump apparatus comprising:

a main refrigerant circuit having a closed loop including a first compressor means for compressing a non-azeotropic refrigerant mixture, a first condenser means for receiving the refrigerant mixture and condensing a highest boiling component thereof while heating a heat output medium, a first gas-liquid separator means for separating the refrigerant mixture into a gas and liquid phase, a pressure reducer means and an evaporator means, a shunting refrigerant line, the shunting refrigerant line including a second compressor means for compressing the gaseous phase of the refrigerant mixture from the first gas-liquid separator means, a second condenser means for receiving the compressed refrigerant mixture from said second compressor means and condensing a medium boiling point component thereof while additionally heating the heat output medium, a second gas-liquid separator means for separating the condensed refrigerant mixture from the second condenser means into a gas and liquid phase, a third compressor means for compressing the gaseous phase of the refrigerant mixture from the second gas-liquid separator means, a third condenser means for receiving the compressed refrigerant mixture from the third compressor means and condensing a low boiling component thereof while further heating the heat output medium.

2. A heat pump apparatus according to claim 1, wherein said shunting refrigerant line includes a pressure reducer means, and wherein an outlet pipe of said pressure reducer means of said shunting refrigerant line is connected to a liquid pipe connected between said gas-liquid separator means and said pressure reducer means of said main refrigerant circuit.

3. A heat pump apparatus according to claim 1, wherein said shunting refrigerant line includes a pressure reducer means, and wherein an outlet pipe of the pressure reducer means of said shunting refrigerant line is connected to a pipe between said pressure reducer means and said evaporator means of said main refrigerant circuit.

4. A heat pump apparatus according to claim 1, further comprising a heater disposed in said gas-liquid separator means of said main refrigerant circuit, and a stop valve disposed at the inlet side of said pressure reducer means of said main refrigeration circuit.

* * * * *